US006053351A

United States Patent [19]

Dunton et al.

[11] Patent Number: 6,053,351

[45] Date of Patent: Apr. 25, 2000

[54] PLATING BASKET WITH IMPROVED SUPPORT STRUCTURE

[76] Inventors: Terry Lee Dunton, 21438 Hilltop Rd., P.O. Box 283, Springboro, Pa. 16435; Garth A. Faivre, Sr., 993 First St., Meadville, Pa. 16335

[21] Appl. No.: 09/092,709

[22] Filed: Jun. 5, 1998

[51] Int. Cl.[7] ..... G65D 6/08; G65D 6/34; G65D 8/08

[52] U.S. Cl. ..... 220/636; 220/605; 220/643; 220/676; 220/DIG. 14

[58] Field of Search ..... 220/491, 493–495, 220/608, 635, 636, 643, 646, 676, 917, DIG. 14, 605; 217/49, 72, 74, 76, 96, 123; 301/59, 74, 80, 64.7

[56] References Cited

U.S. PATENT DOCUMENTS

| | | | |
|---|---|---|---|
| 152,233 | 6/1874 | Kelly | 217/96 |
| 348,269 | 8/1886 | Dodge | 301/64.1 X |
| 411,887 | 10/1889 | Dean | 301/74 X |
| 866,087 | 9/1907 | Temper | 220/495 X |
| 1,650,452 | 11/1927 | Kenmore et al. | 301/80 |
| 1,816,351 | 7/1931 | Adams | 301/80 |
| 2,283,488 | 5/1942 | Cox | 220/493 X |
| 3,946,940 | 3/1976 | Tadokoro | 494/36 |
| 4,381,982 | 5/1983 | Metzger . | |
| 5,386,926 | 2/1995 | Assier . | |
| 5,466,408 | 11/1995 | Assier . | |
| 5,476,114 | 12/1995 | Tanner et al. . | |
| 5,549,215 | 8/1996 | Cruce et al. | 220/676 |
| 5,858,234 | 1/1999 | Sukun | 210/460 |

OTHER PUBLICATIONS

"Series PS—Polypropylene Baskets Stainless Steel Handles"—Meadville New Products Inc. Publication—One Page.

"Centrifugal Dryers"—Atotech USA Inc. Publication—One Page.

"Centrifugal Dryers and Baskets"—Desco, Inc. Publication—Three Pages.

"New Holland Dryers"—Machine Shop Guide Advertisement—Mar. 1998—One Page.

"Dipping Baskets"—BACO Plastics, Inc. Publications—One Page.

"Heavy Duty Plastic Baskets"—BACO Plastics, Inc. Publication—One Page.

"Polypropylene Dipping Baskets"—U.S. Plastics Internet Advertisement—One Page.

"Molded Mesh Basket—Flush Bottom"—Sterling Systems Publication—One Page.

*Primary Examiner*—Stephen K. Cronin
*Assistant Examiner*—Joe Merek
*Attorney, Agent, or Firm*—Conley & Grigsby, P.C.

[57] ABSTRACT

A plating basket (10) wherein a sidewall (12) is connected to a bottom (14) by a rim (24). The basket (10) includes a support structure (38) having a hub (40) that is jointed to spokes (60) such that the structure is compatible with the rotary mechanism of commercially available dryers.

12 Claims, 5 Drawing Sheets

PLATING BASKET WITH IMPROVED SUPPORT STRUCTURE

BACKGROUND OF THE INVENTION

1. Field of the Invention

The subject invention is directed to equipment for use in electroplating processes and, more particularly, to a container for holding items that are to be plated.

2. Description of the Prior Art

Electroplating processes have been used for many years to apply a metallic layer to the surface of various items. Basically, the item to be plated is suspended in a metallic solution while an electrostatic potential is applied to the item. The electrostatic potential results in an electrochemical process by which metallic ions in solution are deposited on the items. The process causes a metal layer to be deposited over the surface of the item. This process is generally used to provide a protective surface finish that is, frequently, also visually attractive.

When a metal layer of the intended thickness has developed, the items are removed from the plating solution and passed through one or more rinse baths. Thereafter, the plated item is dried.

When the items to be plated are relatively small, the items are usually placed together in a single container and plated at one time. The container is constructed of an electrically non-conductive material such as polypropylene or, alternatively, is coated with an electrically non-conductive material so that the plated metal does not accumulate on the container. Typically, the container has a number of slots, holes or other passageways so that the electroplating solution and the other fluids for cleaning and rinsing the item may pass readily to the items. When the plating process is of the type in which the containers are moved manually between the various tanks of plating, cleaning and rinsing solutions, the container is often in the general shape of a perforated bucket or basket. Examples are shown in U.S. Pat. Nos. 5,386,926 and 5,466,408.

Different items present various difficulties in the plating process. The difficulties depend on the size, shape and composition of the plated item as well as the particular metal that is being plated. In the case where many small parts are being plated, one of the problems has been that at the end of the plating process it has been difficult to "dry" the items, that is to remove residual fluids from the interstitial spaces between the items.

Various machines are commercially available to aid in this drying process. In the operation of those machines, when the container of items is removed from the last rinse fluid, the entire container is placed in one of these dryers. These dryers rotate the entire basket of items at a rapid angular velocity. The resultant radial forces acting on the entrapped fluids cause the fluids to flow toward the container wall and through the openings therein.

The dryers are produced by various manufacturers and, consequently, the dryers have a variety of mechanisms for engaging and rapidly spinning the basket. One difficulty with dryers that are manufactured for this application has been that the engagement mechanisms of all dryers are not compatible with all basket designs. For example, because many baskets are made of electrically non-conductive materials such as polypropylene, they also require reinforcing members in the bottom of the baskets so that the basket will support the weight of the plated items. In many baskets these reinforcing pieces are cross-members that are joined together at the centerpoint of the container bottom. This structure is compatible with the engagement mechanisms of some dryers, but not with others. In other baskets, the reinforcing pieces are joined in a square grid that is open at the centerpoint of the container bottom, but that has non-radial members near the outer perimeter of the basket. This structure also is compatible with the engagement mechanism of some dryers, but not with others.

Incompatibility between plating baskets and dryers has sometimes complicated user requirements for material handling of plated parts as well as basket inventory requirements. Accordingly, there was a need in the prior art for a plating basket that was sufficiently strong to support the weight of the plated items, but also that was compatible for use with all commercial dryers.

SUMMARY OF THE INVENTION

The presently disclosed invention is a container of the type that is used to hold articles during a metal plating process. The container includes a body that has a multiplicity of holes that provide fluid pathways into and out of the container. The container has at least one external reinforcing member and also has a support structure that is connected to the reinforcing member. The support structure has a central member that defines an opening therein and also has a plurality of radially aligned members. One end of each radially aligned member is connected to the central member and the other end of each radially aligned member is connected to the external support structure.

Preferably, the body includes a sidewall that is closed to form a continuous internal surface together with a bottom that is connected to the sidewall and closes one open end of this sidewall. The support structure is located adjacent to the external face of the bottom.

More preferably, the closed sidewall is in the general shape of an open right circular cylinder, the bottom is in the general shape of a circular disc, and the central member of the support structure is in the general shape of a circular band that is substantially centered on the centerpoint of the circular bottom.

Most preferably, the radially aligned members are connected to the central member by a jointed connection and the radial members are enlarged near the jointed connection to provide pedestals on each side of the joint.

Other details, objects and advantages of the subject invention will become apparent as the following description of the presently preferred embodiment proceeds.

BRIEF DESCRIPTION OF THE DRAWINGS

A presently preferred embodiment of the subject invention is shown and described in connection with the accompanying drawings wherein.

DESCRIPTION OF THE PREFERRED EMBODIMENT

Figure 1:
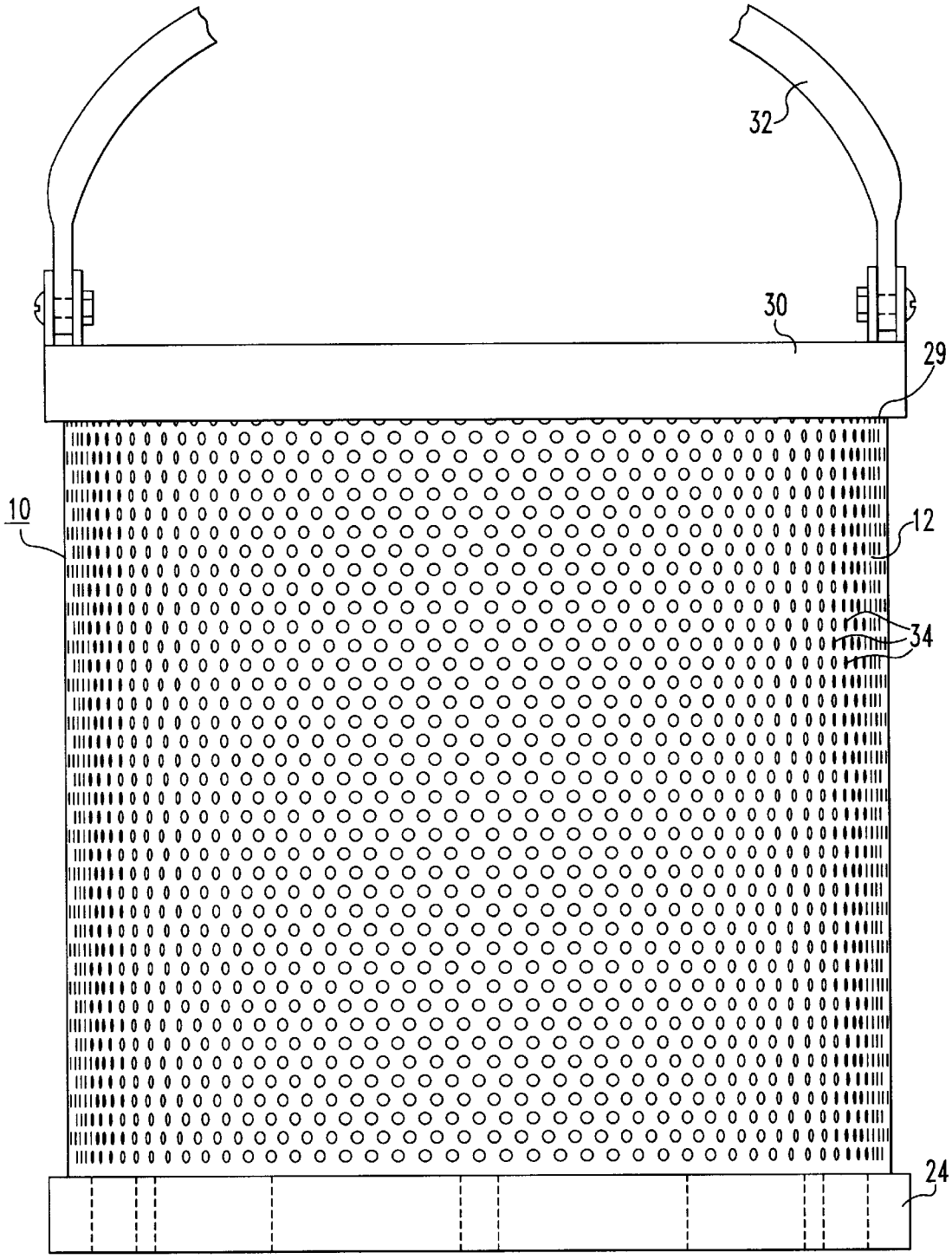
FIG. 1 is an elevation view of a plating basket in accordance with the disclosed invention.

A presently preferred embodiment of the subject invention is particularly described in connection with FIGS. 1–3 wherein a plating basket 10 is formed by a body that includes a sidewall member 12 and a bottom 14. Sidewall 12 has a substantially circular cross-section such that it has a closed, continuous internal surface 16 and a continuous external surface 18. In the preferred embodiment, sidewall 12 has a substantially circular cross-section, although sidewalls of other cross-sectional shapes are also within the scope of the disclosed invention.

Bottom 14 is in the general shape of a circular plate in correspondence with the cross-sectional shape of sidewall 12. The circular plate has a centerpoint 19. Alternative cross-sectional shapes of sidewall 12 would require corresponding shapes for bottom 14. Bottom 14 has an internal surface 20 and an external surface 22.

In the preferred embodiment, a reinforcing member such as rim 24 is used to connect sidewall 12 to bottom 14. Specifically, one edge 26 of sidewall 12 is butted into a circular groove 28 that is located in rim 24. Bottom 14 is then connected to rim 24 by a plastic weld or equivalent means. In this way, bottom 14 closes the end of sidewall 12 that is defined by edge 26.

Sidewall 12 also includes edge 29 that is oppositely disposed from edge 26. Edge 29 defines an opening that communicates with the internal cavity defined by internal surface 16 of sidewall 12 and internal surface 20 of bottom 14.

Edge 29 of sidewall 12 is provided with a reinforcing member such as rim 30 that is attached to external surface 18 of sidewall 12. As particularly shown in FIG. 1, a handle 32 or equivalent means can be connected to rim 30 to facilitate carrying the disclosed basket.

Figure 3:
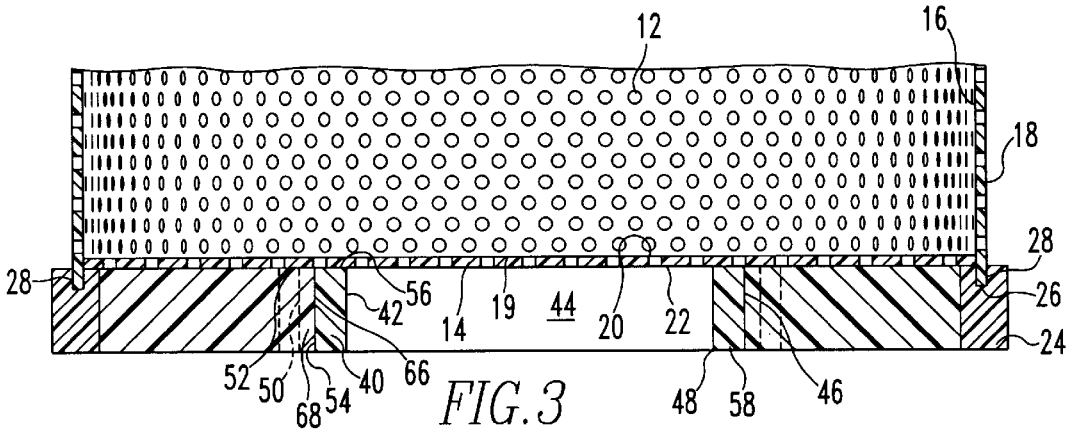
FIG. 3 is a cross-sectional elevation view taken along the lines 3—3 of FIG. 2.
Figure 2:
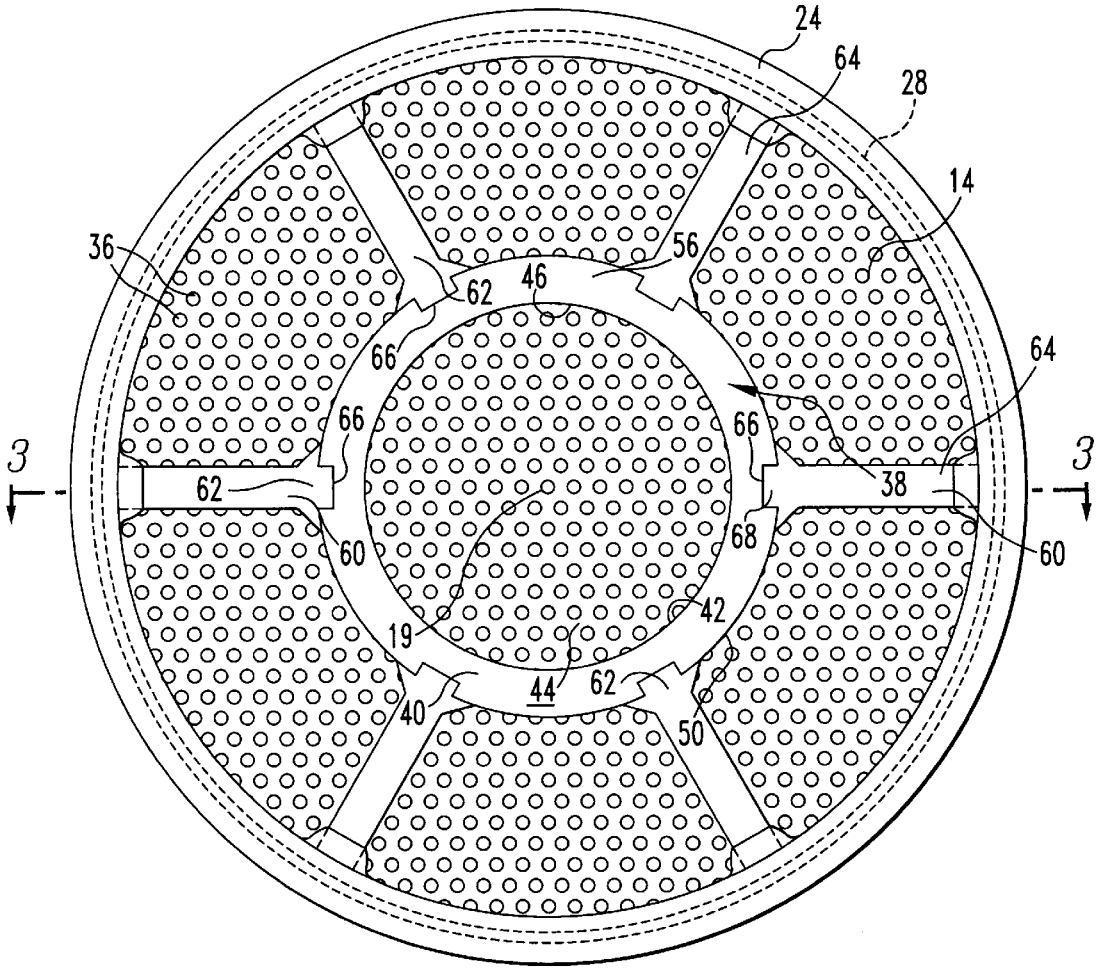
FIG. 2 is a bottom view of the basket shown in FIG. 1.

FIGS. 1–3 show that sidewall 12 and bottom 14 are provided with a multiplicity of holes 34 and 36 respectively. Holes 34 and 36 provide fluid pathways between internal surface 16 and external surface 18 and between internal surface 20 and external surface 22. Such pathways allow ingress and egress of fluid cleaning agents, plating baths, and rinses during the plating process and also allow fluids to be expelled by centrifugal dryers as is well known and understood by those skilled in the art.

Basket 10 is preferably comprised of polypropylene or equivalent material that is non-reactive in the electroplating process such that plated metals are not deposited in basket 10.

Due to strength-of-material considerations, the preferred embodiment of FIGS. 1—3 further shows a support structure 38 that is located adjacent to external surface 20 of bottom 14. Support structure 38 braces bottom 14 and supports it against the weight of plated items (not shown) that are contained in basket 10. Support structure 38 includes a central member such as a band or hub 40 that is centered on centerpoint 19 and bottom 14. Hub 40 has an inner radial surface 42 that defines a central opening 44. Hub 40 is in the shape of a circular band such that inner radial surface 42 has first and second inner circular edges 46 and 48 respectively. Hub 40 also includes an outer radial surface 50 that has first and second outer circular edges 52 and 54 respectively. Hub 40 has a first end surface 56 between inner circular edge 46 and outer circular edge 52. Hub 40 also has a second end surface 58 between inner circular edge 48 and outer circular edge 54.

Support structure 38 further includes a plurality of members such as spokes 60 that are aligned in a direction that is radial with respect to hub 40. Spokes 60 each have first and second oppositely disposed ends 62 and 64 with end 62 being joined to hub 40 and end 64 being attached to rim 24.

Ends 64 of spokes 60 are connected to rim 24 by plastic welds. As particularly shown in FIGS. 4 and 5, ends 62 of spokes 60 are jointed with hub 40. More specifically, hub 40 is provided with a keyway 66 corresponding to each spoke 60. Keyways 66 extend between edges 52 and 54 of outer radial surface 50 and are in the general shape of a rectangular groove. Keyways 66 are located on hub 40 at regular angular positions such that the radial angles between corresponding points (e.g., the center of the keyway) of said keyways are substantially equal. Ends 62 of spokes 60 have key extensions 68 that are receivable in respective keyways. When key extensions 68 are received in a respective keyway 66, a joint is formed between hub 40 and the spoke 60.

Figure 4:
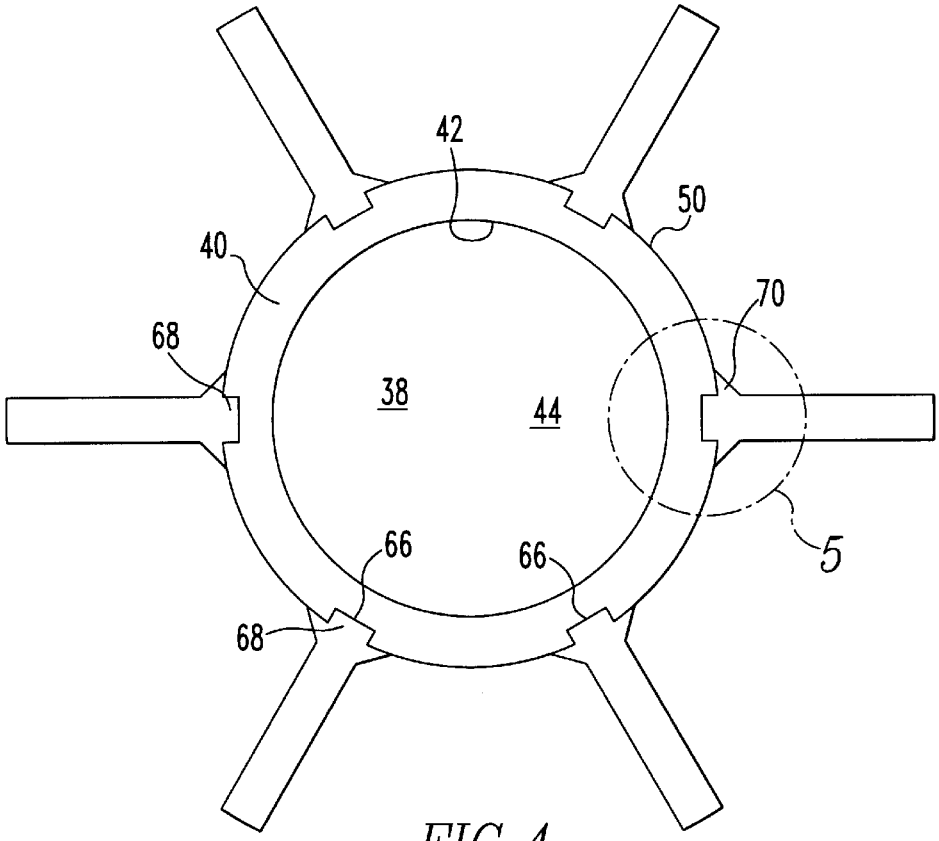
FIG. 4 is a view of the support structure of FIG. 2 shown in isolation.
Figure 5:
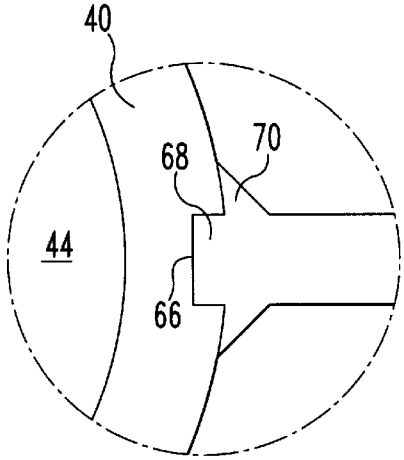
FIG. 5 is a view of a portion of the support structure shown in FIG. 4 that has been enlarged to better disclose the jointed members.

As also shown in FIGS. 4 and 5, spokes 60 are shaped such that in the region of spoke 60 that is adjacent to end 62, the diameter or cross-section of spokes 60 progressively increases along the longitudinal axis of spoke 60 moving in the direction toward end 62. In this way, when spokes 60 and hub 40 are assembled together in a joint, the portion of spokes 60 adjacent to the joint forms a pedestal 70 that further strengthens support structure 38.

Figure 6:
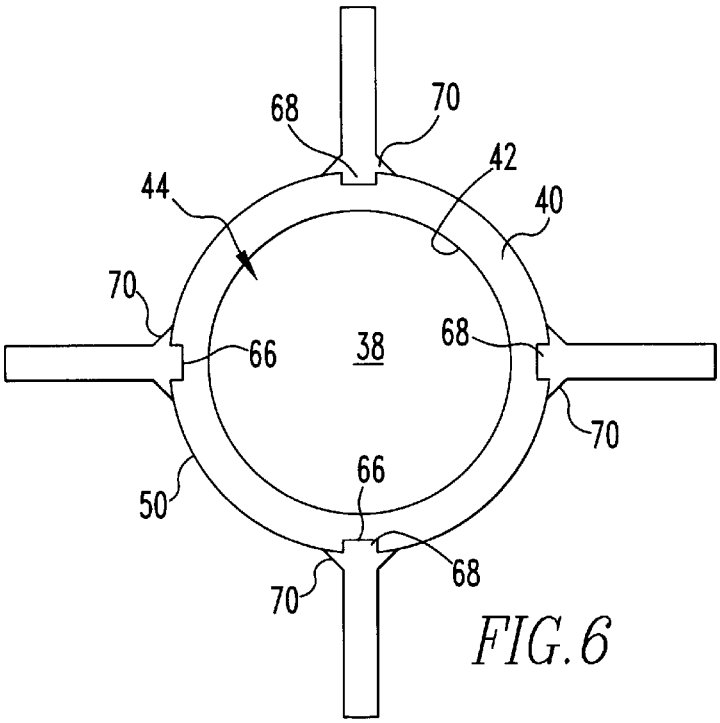
FIG. 6 shows an alternative embodiment of the support structure shown in FIG. 4.
Figure 7:
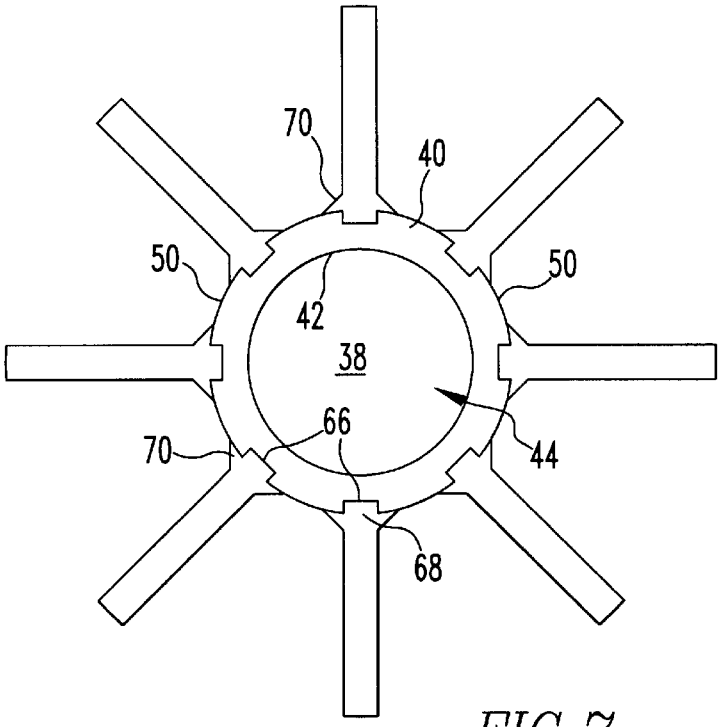
FIG. 7 shows another alternative embodiment of the support structure shown in FIG. 4.
Figure 8:
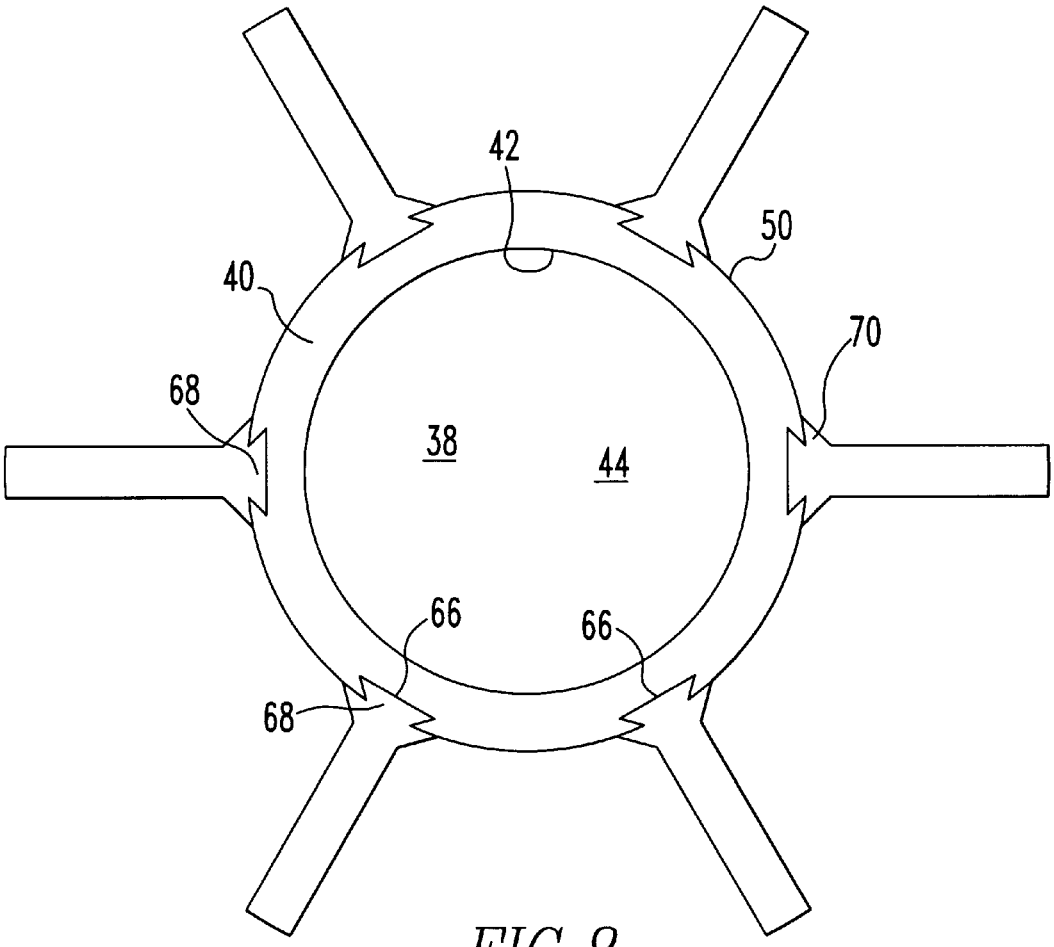
FIG. 8 shows another alternative embodiment of the support structure shown in FIG. 4.

The preferred embodiment of FIGS. 1–4 illustrates the use of six spokes 60. This is because it has been found that, in many applications, the use of six spokes generally provides a better integrated fit with the rotary mechanism of commercially available dryers. However, the subject invention also includes the use of other numbers of spokes such as four spokes as shown in FIG. 6 and eight spokes as shown in FIG. 7.

Baskets with the support structure 38 disclosed herein have been found to work compatibly with all commercially available dryers that are intended for use with such plating baskets. This is because support structure 38 having the hub 40 and spoke 60 combination as herein disclosed accommodates the rotary mechanisms of each of such dryers while also providing sufficient strength and rigidity to support bottom 14.

While a presently preferred embodiment has been disclosed herein, the subject invention is not specifically limited thereto but may be otherwise variously embodied within the scope of the following claims.

We claim:

1. A container for receiving and confining articles that are to be plated, said container comprising:

a body that has a sidewall member and a bottom member, each of said sidewall member and said bottom member having a respective external surface and also having a respective internal surface with the external surface of the bottom member having a center point, said sidewall member and said bottom member cooperating to define an internal cavity for receiving the articles, said sidewall member also defining an opening that communicates with the internal cavity and each of said sidewall member and said bottom member having a multiplicity of perforations that provide separate fluid pathways between the respective internal surface and the external surface of each of the sidewall member and the bottom member;

at least one reinforcing member that is attached to the external surface of said body; and a support structure that is located adjacent to the external surface of said body, said support structure having a central member that defines an opening therein, said opening encompassing the center point of the external surface of the bottom member, said support structure also including a plurality of spokes having first and second ends, the first end of each of said spokes being respectively connected to the central member and the second end of each of said spokes being respectively connected to said reinforcing member.

2. A container for use in an electroplating process, said container comprising:

a sidewall member that has a continuous internal surface and a continuous external surface, said sidewall member including a multiplicity of holes that provide a fluid pathway between the internal surface and the external surface of said sidewall member;

a bottom member that has an internal surface and an external surface with the external surface having a center point, said bottom member being connected to said sidewall member and closing one end of said sidewall member, said bottom member having a multiplicity of holes that provide a fluid pathway between the internal surface and the external surface of said bottom member;

at least one reinforcing member that is attached to the external surface of said sidewall member; and a bottom support structure that is located adjacent to the external surface of said bottom member, said bottom support structure having a hub member that defines a central opening therein with said central opening encompassing the center point of the external surface of the bottom member, said bottom support structure also having a plurality of spokes with each of said spokes having first and second ends, the first end of each of said spokes being connected to the hub member and the second end of each of said spokes being connected to a reinforcing member.

3. The container of claim 2 wherein the hub of said bottom support structure comprises a band that has an inner surface and an outer surface and wherein the first ends of said spokes are connected to the hub at the outer surface.

4. The container of claim 3 wherein the band is a circular band having an inner radial surface and an outer radial surface and wherein the first ends of said spokes are connected to the band at the outer radial surface.

5. The container of claim 3 for use with a dryer having a drive spindle wherein the inner radial surface of the band defines an opening that receives the drive spindle of the dryer.

6. The container of claim 5 wherein the first ends of said spokes are jointed with said band.

7. The container of claim 6 wherein said jointed structure between said band and the first end of said spokes is a dovetail joint.

8. The container of claim 2 wherein said band and said spokes are comprised of plastic and wherein the second ends of said spokes are secured to the reinforcing member by at least one plastic weld.

9. A container for use in an electroplating process, said container comprising:

a frame that includes first and second annular bands that are substantially aligned on a common central axis, said first annular band having an internal surface and an external surface, said second annular band also having an internal surface and an external surface;

a container sidewall that has an internal surface and an external surface and that is concentrically supported by the first and second bands, said sidewall having a multiple of openings that provide fluid pathways between the internal surface and the external surface of the sidewall;

a container bottom that has an internal surface and an external surface with the external surface having a center point, said container bottom being connected to said container sidewall, said container bottom having a multiple of openings that provide fluid pathways between the internal surface of the bottom and the external surface of the bottom; and a bottom support structure that is secured to the internal surface of the second annular band, said bottom support structure having a band that encompasses the center point of the external surface of the container bottom, said bottom support also having a plurality of spokes with each of said spokes having one end connected to the band and having the opposite end connected to the second annular band.

10. The container of claim 9 wherein said bottom support structure has six spokes.

11. A container for use in an electroplating process, said container comprising:

a sidewall member that has an internal surface and an external surface, said sidewall member including a multiplicity of holes that provide a fluid pathway between the internal surface and the external surface of said sidewall member;

a bottom member that has an internal surface and an external surface with the external surface having a center point, said bottom member being connected to said sidewall member and closing one end of said sidewall member, said bottom member having a multiplicity of holes that provide a fluid pathway between the internal surface and the external surface of said bottom member;

a circular band that defines an internal opening that encompasses the center point of the external surface of the bottom member, said circular band having an inner radial surface that has first and second inner circular edges and an outer radial surface that has first and second outer circular edges, said circular band also having a first end surface between said first inner circular edge and said first outer circular edge, said circular band also having a second end surface between said second inner circular edge and said second outer circular edge, said circular band also having keyways that extend between the first and second outer circular edges of the outer radial surface; and a plurality of radially extending members, each of said members having respective first and second ends with the first end of each of said members being joined to said circular band, the first end of each of said radially extending members having a key extension that is receivable in at least one of said keyways such that the key extension of said extension member is received in a respective one of said keyways in said band to form a joint between said band and said radially extending member.

12. The support structure of claim 11 where the cross-section of said radially extending members is increased in the region adjacent to said first end of said radially extending member to form a pedestal in said radially extending member adjacent to said circular band.

* * * * *